US006349488B1

(12) United States Patent
Mason

(10) Patent No.: US 6,349,488 B1
(45) Date of Patent: Feb. 26, 2002

(54) TECHNICAL FIELD

(76) Inventor: Michael J. Mason, 15981 Summitview, Cowiche, WA (US) 98923

( * ) Notice: Subject to any disclaimer, the term of this patent is extended or adjusted under 35 U.S.C. 154(b) by 0 days.

(21) Appl. No.: 09/438,825

(22) Filed: Nov. 12, 1999

(51) Int. Cl.[7] ..... E02F 5/08
(52) U.S. Cl. ..... 37/94; 37/189
(58) Field of Search ..... 37/189, 190, 462, 37/464, 465, 347, 365, 91, 92, 94; 405/180, 181, 159, 161

(56) References Cited

U.S. PATENT DOCUMENTS

| | | | | | |
|---|---|---|---|---|---|
| 2,568,959 | A | | 9/1951 | Illies | 212/55 |
| 2,883,067 | A | | 4/1959 | Davis | 212/66 |
| 2,969,601 | A | | 1/1961 | McMaster | 37/94 |
| 3,387,891 | A | | 6/1968 | Simms et al. | 299/39 |
| 3,419,976 | A | | 1/1969 | Reising | 37/94 |
| 3,514,038 | A | | 5/1970 | McQuinn | 239/165 |
| 3,683,522 | A | | 8/1972 | Rousseau et al. | 37/91 |
| 3,834,049 | A | | 9/1974 | Bond | 37/86 |
| 3,896,570 | A | * | 7/1975 | McMurray | 37/87 |
| 4,010,900 | A | | 3/1977 | Flix et al. | 239/168 |
| 4,034,875 | A | | 7/1977 | Pugh et al. | 214/141 |
| 4,044,952 | A | | 8/1977 | Williams et al. | 239/165 |
| 4,119,154 | A | * | 10/1978 | Miller | 171/16 |
| 4,252,274 | A | | 2/1981 | Kubacak | 239/163 |
| 4,459,767 | A | | 7/1984 | Cartner | 37/81 |
| 4,475,604 | A | | 10/1984 | Albertson et al. | 175/85 |
| 4,523,684 | A | | 6/1985 | Baisden | 212/175 |
| 4,542,940 | A | * | 9/1985 | Marten | 299/1 |
| 4,612,715 | A | | 9/1986 | Cartner | 37/92 |
| 4,709,736 | A | | 12/1987 | Bellars | 144/2 |
| 4,727,691 | A | | 3/1988 | Kubacak | 52/114 |
| 4,787,324 | A | | 11/1988 | DeWitt et al. | 239/165 |
| 4,808,026 | A | | 2/1989 | Clarke, Jr. et al. | 404/90 |
| 4,832,412 | A | | 5/1989 | Bertrand | 299/39 |
| 4,942,682 | A | * | 7/1990 | McDowell | 37/66 |
| 5,027,534 | A | | 7/1991 | Sackett | 37/91 |
| 5,135,287 | A | | 8/1992 | Karnes | 299/39 |
| 5,212,897 | A | | 5/1993 | Jefferson | 37/103 |
| 5,245,769 | A | | 9/1993 | Wammock | 37/357 |
| 5,247,743 | A | | 9/1993 | Holloway et al. | 37/355 |
| 5,645,179 | A | | 7/1997 | Mohar | 212/180 |
| 5,864,970 | A | | 2/1999 | Maddock et al. | 37/94 |
| 6,125,943 | A | * | 10/2000 | Valois | 172/15 |

* cited by examiner

*Primary Examiner*—Victor Batson
(74) *Attorney, Agent, or Firm*—Stratton Ballew PLLC

(57) ABSTRACT

A trencher mountable on a vehicle such as a tractor, includes a substantially horizontal hollow stationary member positioned substantially perpendicular to the direction of travel of the vehicle, an extension member which is slidably receivable within the stationary member and a member for extending and retracting the extension member with respect to the stationary member. The trencher further includes a swiveling member pivotably attached to one end of the extension member with the swiveling member being horizontally pivotable with respect to the extension member. The trencher further includes a trenching head attached to the other end of the swiveling member, the trenching head including a trenching wheel and a device for pivotably raising and lowering the trenching head with respect to the swiveling member, and a frame for mounting the trencher to the vehicle.

18 Claims, 12 Drawing Sheets

TECHNICAL FIELD

TECHNICAL FIELD

The invention relates to the field of digging implements. More specifically, the invention provides an apparatus and method for digging narrow trenches.

BACKGROUND OF THE INVENTION

In the field of irrigation system installation, as well as in other fields, it is often necessary to provide shallow, narrow trenches in which to bury irrigation pipes and the like. The formation of the trenches is usually achieved using a trencher. The trencher is a device which cuts into the soil to leave a narrow trench of desired depth. The trencher may either be a complete implement including motivation means, or it may be an implement which is attachable to the power take-off (PTO) or hydraulics system of a powered implement such as a tractor, backhoe or loader. Generally, the trencher is substantially centered behind the motivation means, creating a trench that is parallel to the direction of travel.

Until recently, the commonly known and commercially available trenchers met the needs of those irrigation system installers who installed irrigation systems in orchards. When it was necessary to install or replace irrigation lines, the installer simply drove the trencher between the trees—either along the defined planting rows, or perpendicular to them—to make trenches where necessary. However, relatively recently evolved cultural practices in orchards, especially apple orchards, have rendered trenchers only partially useful in digging trenches for orchard irrigation lines. Specifically, many orchardists have begun replacing older trees with new varieties which grow closer to the ground, and require trellising for optimal production. The trellising and the trees themselves make it impossible for a conventional trencher to pass between trees perpendicular to the planting rows. Therefore, any additional or replacement irrigation lines in an established trellised orchard require that the trench be dug by hand. A similar problem exists in vineyards, where grape plants are planted too close together to allow the passage of a conventional trencher or tractor.

SUMMARY OF INVENTION

The present invention provides a trencher which is mountable on a vehicle such as a tractor. The trencher includes a hollow stationary member, and an extension member which is slidably receivable within the stationary member. A means is provided for extending and retracting the extension member with respect to the stationary member. The trencher further includes a swiveling member pivotably attached to one end of the extension member, and a trenching head attached to the end of the swiveling member. The swiveling member is securable in a position parallel to the extension member. A means is provided for raising and lowering the trenching head with respect to the swiveling member. The trencher is mounted to the vehicle with a mounting frame.

In an embodiment of the invention, the means for raising and lowering the trenching head is a hydraulic actuator.

In an additional embodiment of the invention, the means for extending and retracting the extending member is a hydraulic actuator.

In a further embodiment of the invention, the swiveling member is alternatively securable in a perpendicular position relative to the extension member.

In an additional embodiment of the invention, the swiveling member is securable in a stored position.

In yet a further embodiment of the invention, the trencher includes a cradle for receiving the trenching head in a stored position.

In an additional embodiment, the trenching head includes a body; a motor having a motor shaft; a motor compartment within the body for receiving the motor; a first sprocket affixed to the motor shaft positioned outside the motor compartment; a wheel shaft for being received within the trenching wheel; a second sprocket affixed to the wheel shaft; and a drive chain operatively engaged between the first sprocket and the second sprocket.

In an embodiment, the trenching head includes a protective case affixed to the body for enclosing the motor shaft, drive chain, and sprockets.

In an embodiment, the trencher includes a first deflector and a second deflector. The first deflector directs dirt and debris away from a newly cut trench, positioned over the trenching head. The first deflector includes a first plate and a second plate. Each plate has an upper edge, and the upper edges meet to form an apex over the trenching wheel. The second deflector is positioned over the trenching head, opposite the first deflector, and is for directing dirt and debris tossed up by the trenching wheel onto the first deflector.

In another embodiment, the first plate and the second plate of the first deflector are made of sheet steel and heavy rubberized fabric. The rubberized fabric is positioned adjacent to the trenching wheel.

In another embodiment, the motor for turning the trenching wheel is a hydraulic motor.

In an additional embodiment, a dolly wheel is attached to the body of the trenching head for supporting the trenching head while in use in a "float" mode.

DETAILED DESCRIPTION OF SPECIFIC EMBODIMENTS

Figure 1:
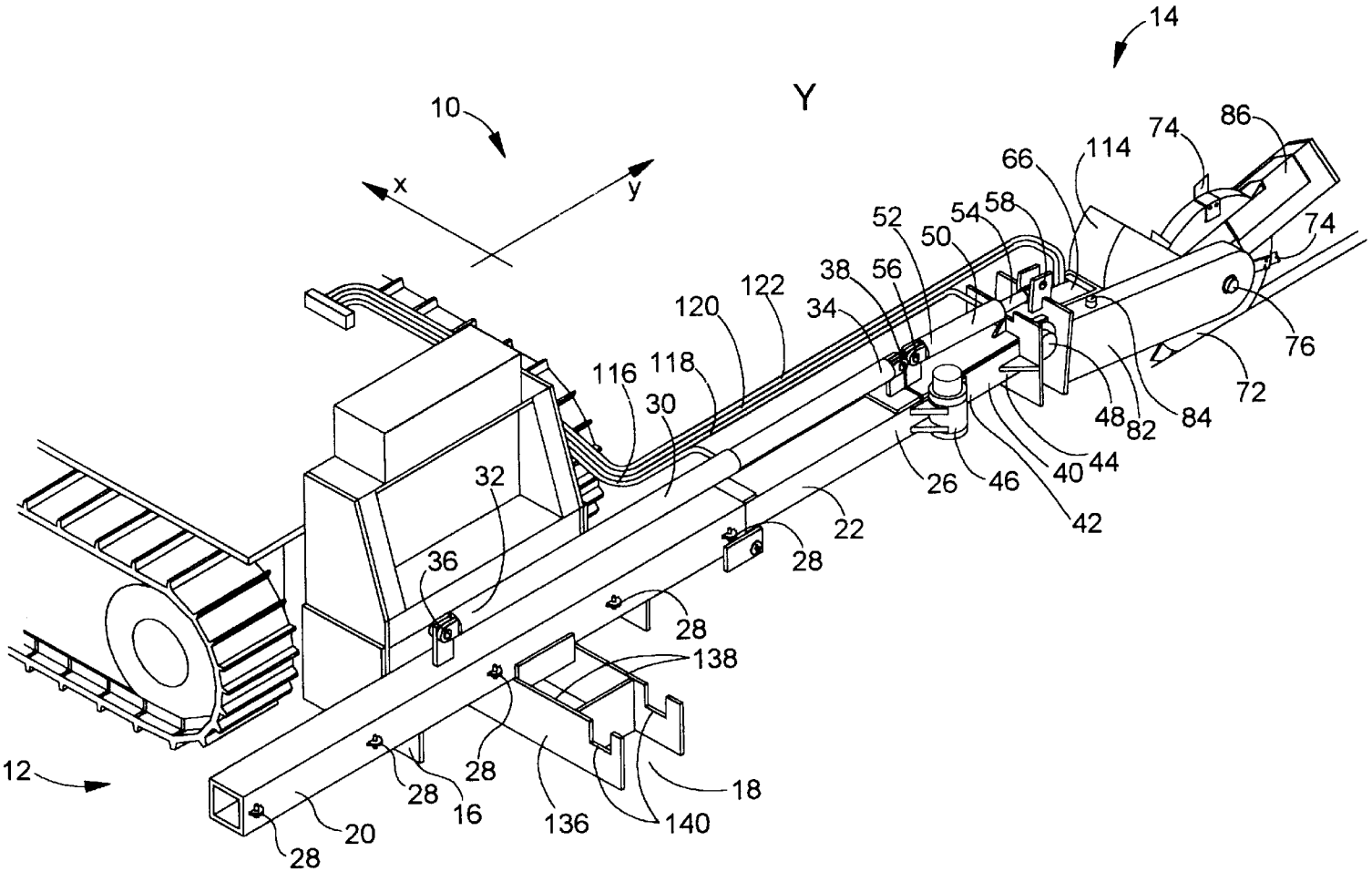
FIG. 1 is a perspective view of a trencher of the present invention, showing the trencher in a parallel, extended position.

The trencher 10 of the present invention is shown in FIGS. 1–15. In general, the trencher comprises an arm 12, a trenching head 14, a mounting frame 16 and a cradle 18 for securing the trenching head in a stored position when not in use. FIGS. 1 through 13 show a preferred embodiment of the trencher attached to a tractor, although the trencher may be used with any vehicle capable of supporting and moving the trencher, and providing power thereto, as will be discussed in greater detail below.

The arm 12 of the trencher 10 includes a horizontal stationary member 20, and an extension member 22 which is slidably received within the stationary member. In an alternative preferred embodiment, the extension member includes two or more telescoping sections (not shown). The extension member 22 of the arm 12 has a first end 24 and a second end 26. The extension member first end is received within the stationary member. In a preferred embodiment of the invention, the stationary member is provided with a plurality of rollers 28 positioned along its length to aid the sliding movement of the extension member therein.

A means for extending and retracting the extension member is provided by the invention. In a preferred embodiment, a first hydraulic actuator 30 having a first end 32 and a second end 34 is provided for extending and retracting the extension member 22 of the arm 12 relative to the stationary member 20. The first end of the first hydraulic actuator is pivotally joined to the stationary member at a first pivot connector 36, and the second end of the first hydraulic actuator is similarly pivotally joined to the extension member at a second pivot connector 38. A hydraulic actuator made by Applied Industrial Technology (part no. 22411) has been used successfully. In addition to a hydraulic actuator, the use of other extending and retracting means is also contemplated.

The arm 12 further comprises a swiveling member 40 having a first end 42 and a second end 44. The second end 26 of the extension member 22 and the first end of the swiveling member are joined by a first hinge 46. The first hinge has a vertical axis, allowing the swiveling member to move on a horizontal plane.

The trenching head 14 of the trencher 10 is joined by a second hinge 48 to the second end 44 of the swiveling member 40. The second hinge has a horizontal axis, permitting the trenching head to be tilted in an upward and downward direction with respect to the swiveling member. A means for raising and lowering the trenching head is provided by the invention. In a preferred embodiment, a second hydraulic actuator 50, having a first end 52 and a second end 54, is pivotally joined at its first end to a third pivot connector 56. The second hydraulic actuator is pivotally joined at its second end to a fourth pivot connector 58. A hydraulic actuator made by Applied Industrial Technology (part no. 2060 B) has been used successfully. In addition to a hydraulic actuator, the use of other means for raising and lowering the trenching head is also contemplated.

Figure 14:
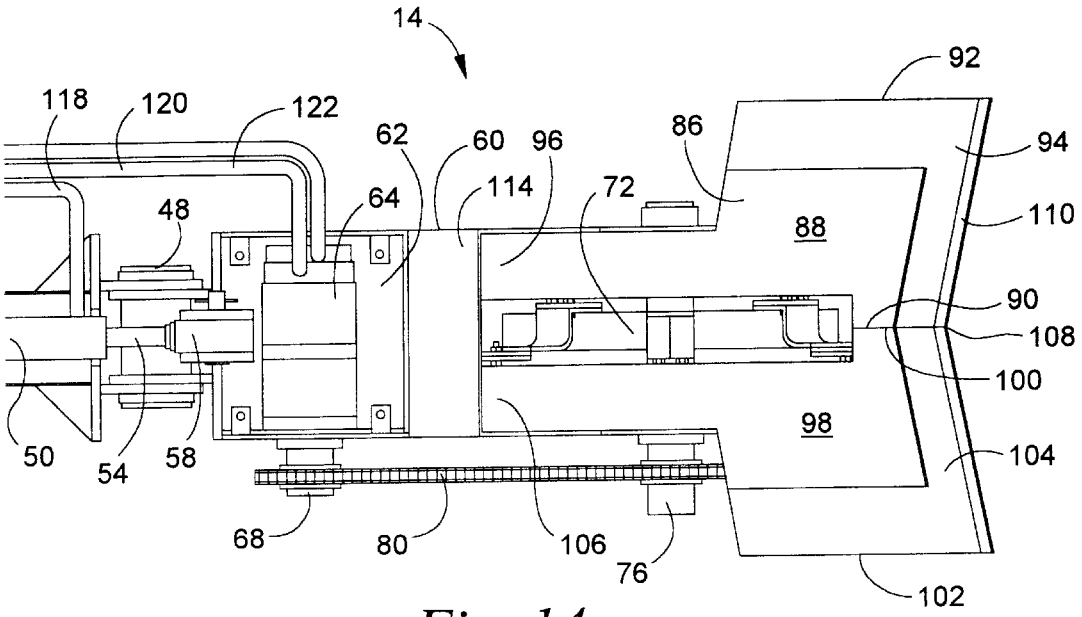
FIG. 14 is a partial top plan view of a trencher of the present invention, showing the trencher head.
Figure 15:
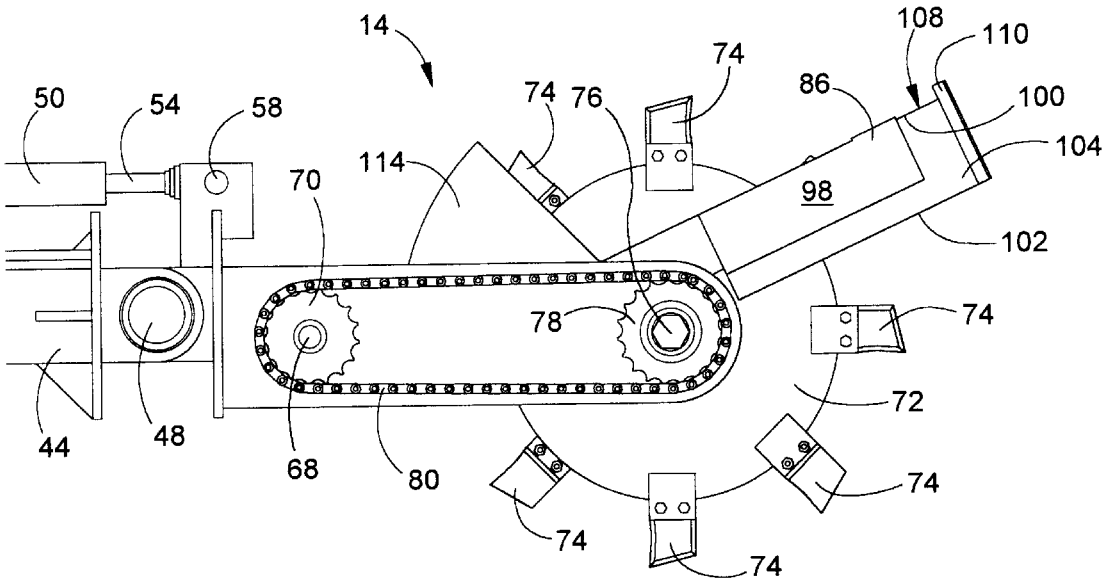
FIG. 15 is a partial side elevation view of a trencher of the present invention, showing the trencher head.

The trenching head 14 is shown in detail in FIGS. 14 and 15. The trenching head includes a body 60 having a motor compartment 62 therein for receiving a motor 64. In a preferred embodiment, the motor is a hydraulic motor. A hydraulic motor made by Applied Industrial Technology (part no. 104-1004) has been used successfully. As shown in FIGS. 1, 2, 3, 5, 6, 8, and 10, a motor compartment cover 66 is provided for enclosing the motor compartment to protect the motor from dirt, rocks and other debris. The motor compartment cover is removably secured on the motor compartment using screws or other fastening means. The motor 64 has a motor shaft 68 which extends through the body 60 to receive a first sprocket 70.

The trenching head 14 further comprises a trenching wheel 72. The trenching wheel has a plurality of teeth 74 attached thereto for breaking up and lifting soil. In a preferred embodiment, the teeth are removably attachable to the trenching wheel. This allows broken or damaged teeth to be quickly and easily removed and repaired or replaced, without having to replace the entire trenching wheel. Digging teeth manufactured by Ditch Witch (part nos. 133-925 and 133-924) have been used successfully.

The digging wheel rotates about a horizontal wheel shaft 76. Preferably, the wheel shaft is hexagonal in cross section, and removably receivable in the trenching wheel. A hex shaft manufactured by Ditch Witch (part no. 145-244) has been used successfully for the wheel shaft. In this preferred embodiment, the trenching wheel is held in position on the wheel shaft with a hex bearing. Hex bearings manufactured by Ditch Witch (part no. 125-620) have been used successfully. The wheel shaft is fitted with a second sprocket 78. A drive chain 80 is operatively engaged on the first sprocket 70 and the second sprocket. Also preferably, the first and second sprockets and the drive chain are enclosed in a protective case 82 as shown in FIGS. 1 through 8 and 10, to prevent debris from fouling the sprockets, drive chain, and cooperating parts. Lubrication of the chain and sprockets is accomplished through a capped port 84 provided in the protective case. Sprockets made by Applied Industrial Technology (part nos. 100BS10X1 and 10010016) have been used successfully for the first and second sprockets.

In a preferred embodiment, the trenching head 14 includes a first deflector 86 for deflecting debris away from a newly cut trench, and away from the wheel shaft 76, as detailed in FIGS. 14 and 15. The first deflector has a first sloped panel 88 with an upper edge 90, a lower edge 92, a leading edge 94, and a trailing edge 96; and a second sloped panel 98 with an upper edge 100, a lower edge 102, a leading edge 104, and a trailing edge 106. The upper edges of the panels meet to form an apex 108, except where a gap between the panels is left for the trenching wheel 72 to protrude. Preferably, the sloped panels are fabricated of sheet steel and heavy rubberized fabric, with the rubberized fabric making up the part of the sloped panels adjacent to the trenching wheel. The rubberized fabric is slightly elastic, and thus minimizes jams caused by rocks becoming wedged between the trenching wheel and the sloped panels. The lower edges of the panels extend laterally beyond the body 60 of the trenching head 14. The leading edges of the panels extend forwardly, beyond the end of the trenching head, and the trailing edges extend in the opposite direction to cover the wheel shaft within the body of the trenching head. In a preferred embodiment, the first deflector further comprises a lip 110 which extends perpendicularly from the leading edges of the panels. The first deflector is affixed to the body of the trenching head with a pair of mounting brackets 112, and extends upwardly and outwardly therefrom.

A second deflector 114 is affixed to the body 60 of the trenching head 14 opposite the first deflector. The second deflector forms a canopy over a portion of the trenching wheel 72, and serves to direct dirt and debris onto the first deflector 86.

According to the invention, power for the hydraulic actuators 30 and 50 and the motor 64 is provided by a hydraulic power source, including one or more pumps, on the vehicle to which the trencher 10 is mounted. A first hydraulic line 116 is provided from the hydraulic power source to the first hydraulic actuator 30; a second hydraulic line 118 is provided from the hydraulic power source to the second hydraulic actuator 50; a third hydraulic line 120 and a fourth hydraulic line 122 are provided from the hydraulic power source to the motor 64. To provide added power to the trenching wheel, the motor may be served by a hydraulic pump separate from the pump serving the hydraulic actuators. Conventional hydraulic valves are utilized to control power to the actuators and motor.

The trencher 10 of the present invention is mounted on a vehicle such as a tractor. In use, the tractor advances in a direction x. The trencher is adapted to dig a trench which follows direction x. Additionally, the trencher is adapted to dig a trench in direction y, where x and y are perpendicular. Thus, the trencher of the present invention can be used in a situation where trenches are required in both direction x and direction y. For example, a low-trellised apple orchard is planted in rows. A tractor can travel along the planting rows, but it cannot travel between the trees, in a direction perpendicular to the planting rows, because the branches and trellising are too close to the ground to permit passage. The trencher of the present invention would be useful in this example, because it can dig a trench along the planting row, in direction x, and then, with a simple adjustment to the trencher, be used to dig trenches in direction y, between the trees of the planting row.

Figure 3:
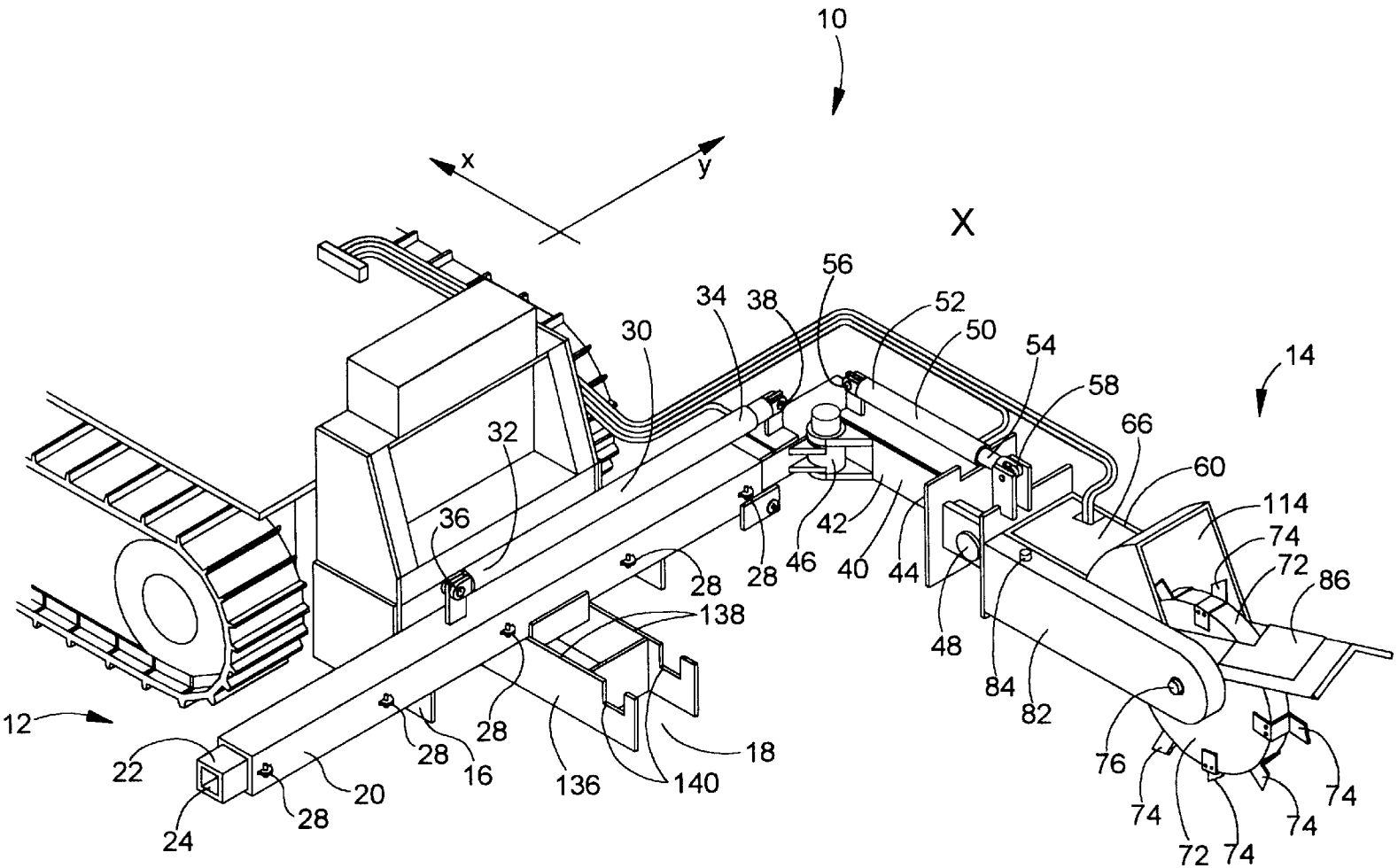
FIG. 3 is a perspective view of a trencher of the present invention, showing the trencher in a perpendicular position.
Figure 8:
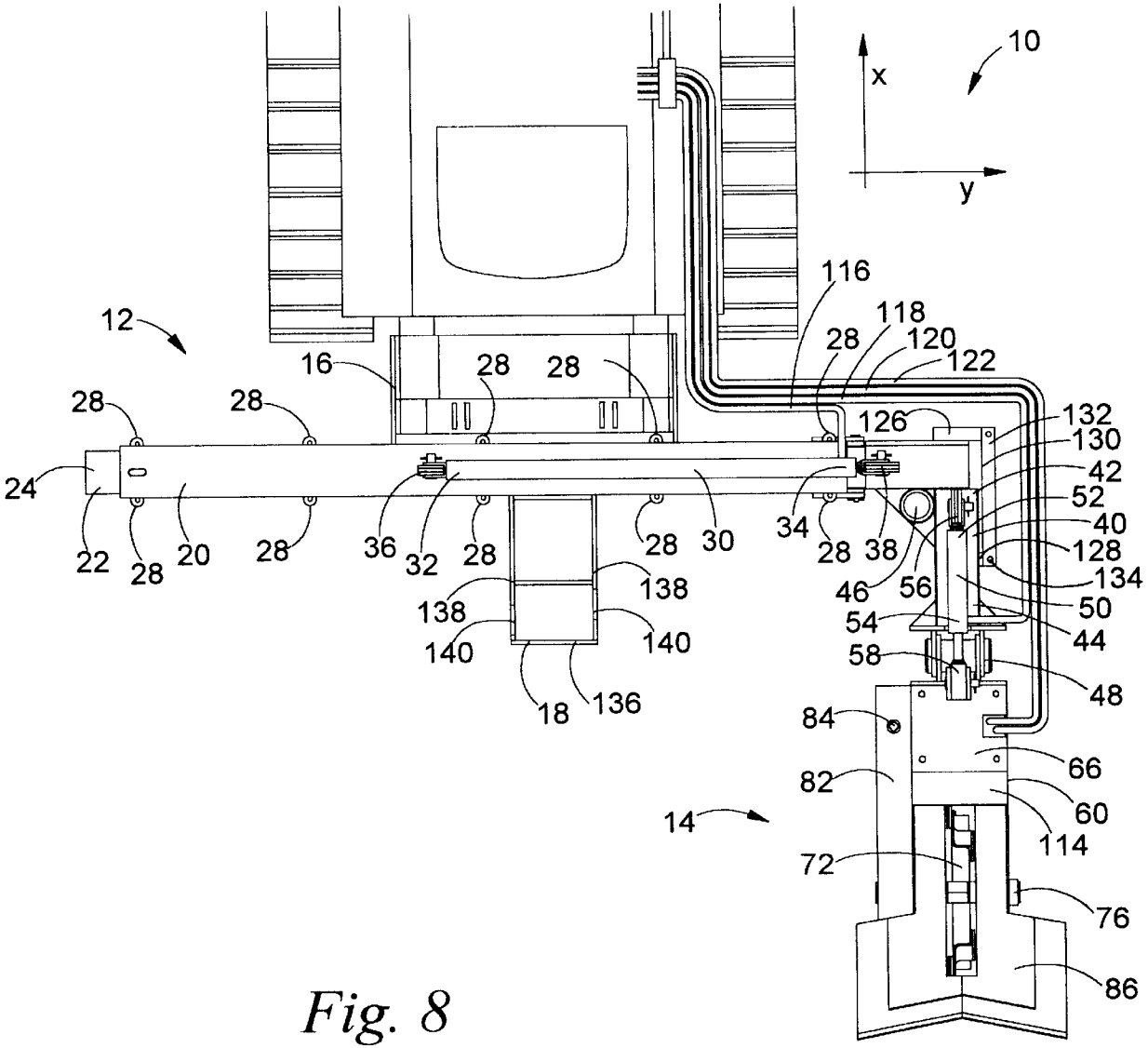
FIG. 8 is a top plan view of a trencher of the present invention, showing the trencher in a retracted perpendicular operating position.
Figure 9:
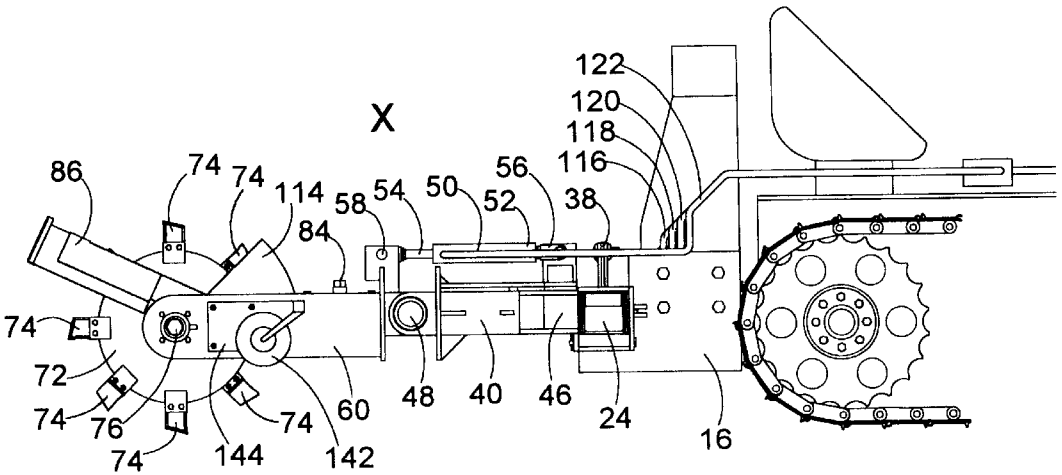
FIG. 9 is a side elevation view of a trencher of the present invention, showing the trencher in a retracted perpendicular operating position.
Figure 13:
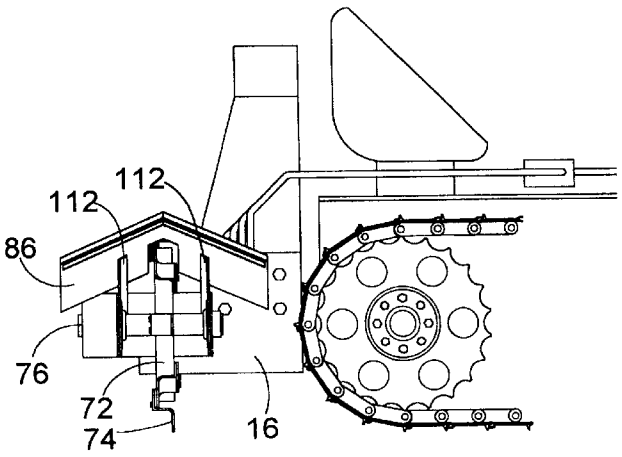
FIG. 13 is a side elevation view of a trencher of the present invention, showing the trencher in a retracted, stored position.
Figure 12:
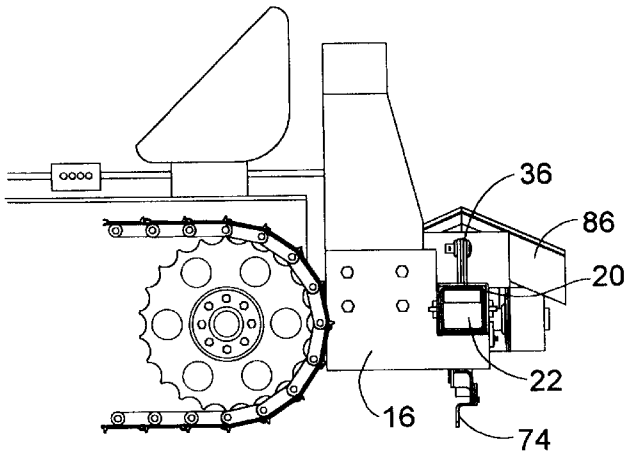
FIG. 12 is a side elevation view of a trencher of the present invention, showing the trencher in a retracted, stored position.
Figure 10:
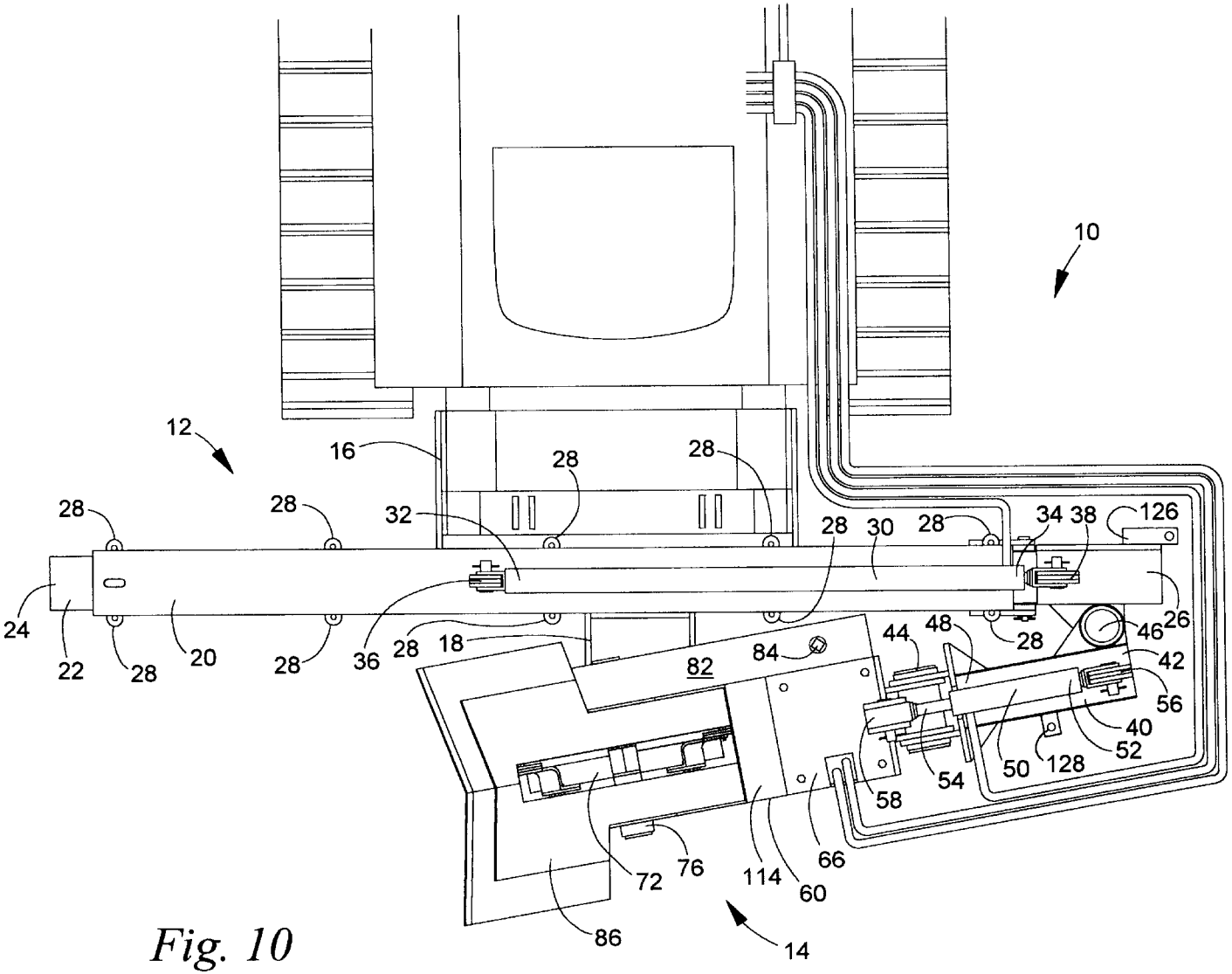
FIG. 10 is a top plan view of a trencher of the present invention, showing the trencher in a retracted, semi-stored position.
Figure 11:
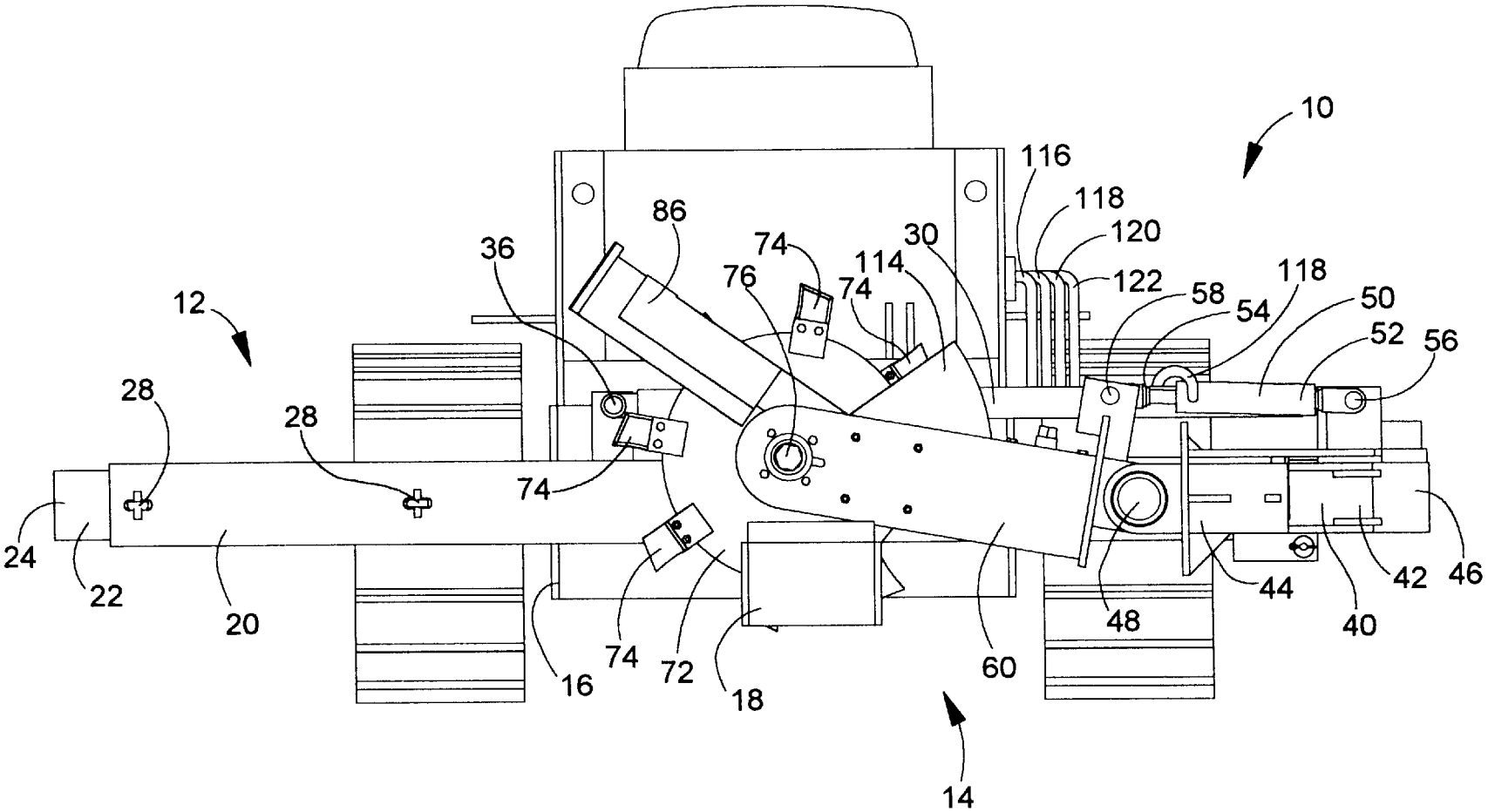
FIG. 11 is a rear elevation view of a trencher of the present invention, showing the trencher in a retracted, stored position.

To use the trencher 10 of the present invention to dig a trench in direction x, the trencher is secured in a first configuration X, as shown in FIGS. 3, 8 and 9. In this configuration, the swiveling member 40 is parallel to direction x, and perpendicular to the extension member 22. In a preferred embodiment, a retaining bar 130 having a first end 132 and a second end 134 is provided for securing the swiveling member in configuration X. Both the first end and the second end of the retaining bar have a hole for receiving a bolt or a peg. The second end 26 of extension member 22 includes a horizontal first tab 126 with a hole therethrough. Similarly, the first end 42 of the swiveling member 40 includes a horizontal second tab 128 with a hole therethough. In use, the hole in the first end of the retaining bar is aligned with the hole in the first tab, and a peg or bolt is inserted into the holes. Likewise, the hole in the second end of the retaining bar is aligned with the hole in the second tab, and a peg or bolt is inserted into the holes to secure the retaining bars in place.

In configuration X, the trencher 10 is operated by activating the hydraulic power supply to extend the first hydraulic actuator 30 from the retracted position shown in FIG. 8, if necessary, to reach the desired starting point. When the arm is extended to the desired length, the trenching head 14 is lowered to the soil by activating the hydraulic power supply to extend the second hydraulic actuator 50, causing the trenching head to pivot in a downward direction on the second hinge 48. In order to begin the trenching operation, the hydraulic power supply is activated to provide power to the motor 64, which turns motor shaft 68. As the motor shaft turns, first sprocket 70 also turns, engaging drive chain 80. The drive chain turns the second sprocket 78, which in turn rotates the trenching wheel 72. As the trenching wheel rotates, the teeth 74 cut a trench in the soil. The trenching head 14 can be lowered to the desired depth once the trenching wheel begins to turn. As the trenching wheel 72 and teeth 74 cut a trench in the soil, dirt and debris are tossed upward into the trenching head, and sprayed out and deflected by the second deflector 114 to land on the first deflector 86. The first deflector directs the dirt and debris away from the trenching wheel, and causes it to fall away outside the newly cut trench.

With the trenching wheel 72 still turning, the vehicle is advanced, thereby causing the trencher 10 to dig a trench in direction x, parallel to the direction of travel of the vehicle. When the trench is complete, the motor 64 is stopped and the second hydraulic actuator 50 is then retracted, thus raising the trenching head 14 above the ground.

In FIGS. 1, 2, 4, 5, 6, and 7, the trencher 10 is shown in configuration Y. In this configuration, the swiveling member 40 is parallel to direction y, and parallel to the extension member 22. In use, the trencher is locked in configuration Y aligning the hole in the horizontal first tab 126 the hole in the horizontal second tab 128, and inserting a peg or bolt 124 therein.

Figure 2:
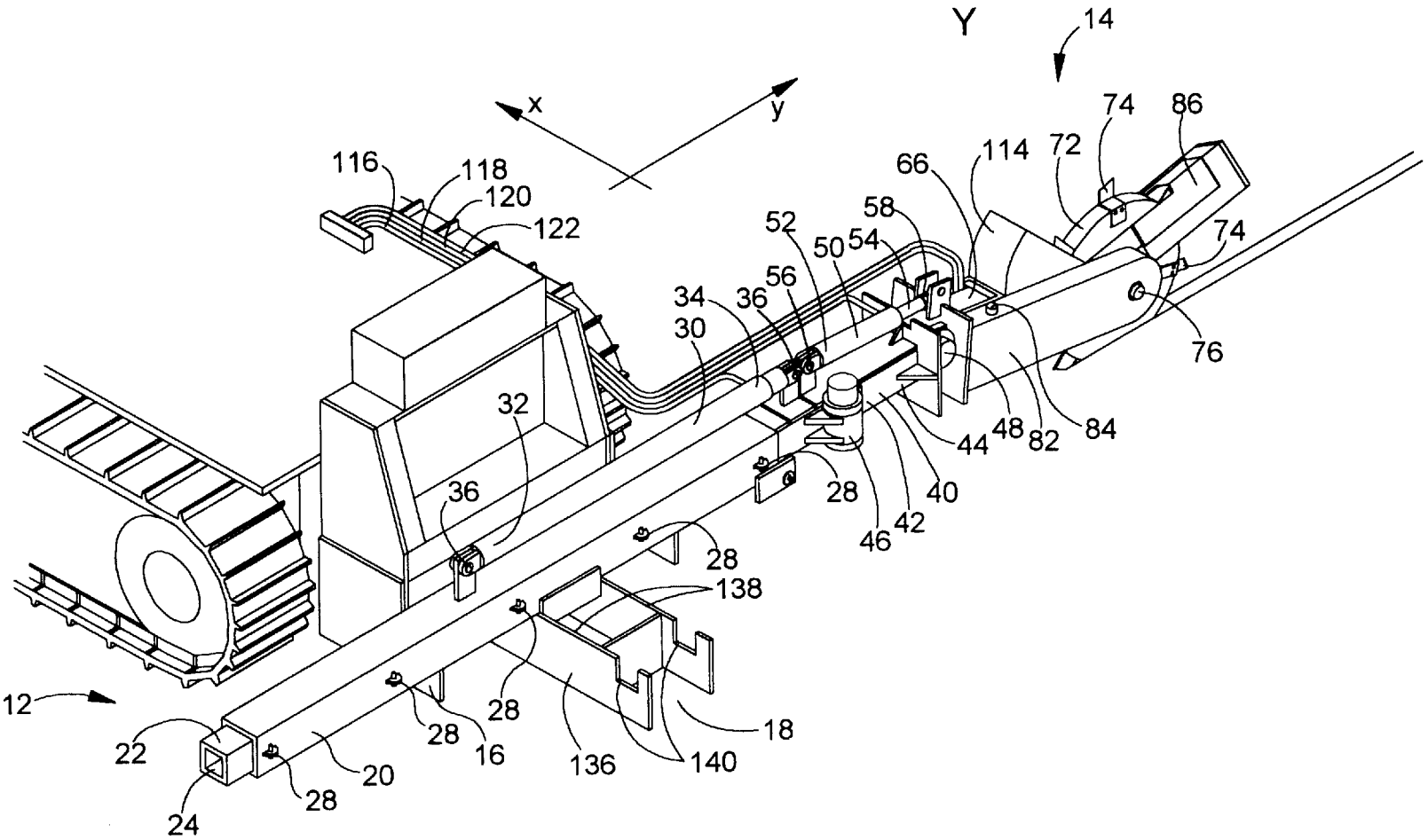
FIG. 2 is a perspective view of a trencher of the present invention, showing the trencher in a parallel, retracted position.
Figure 4:
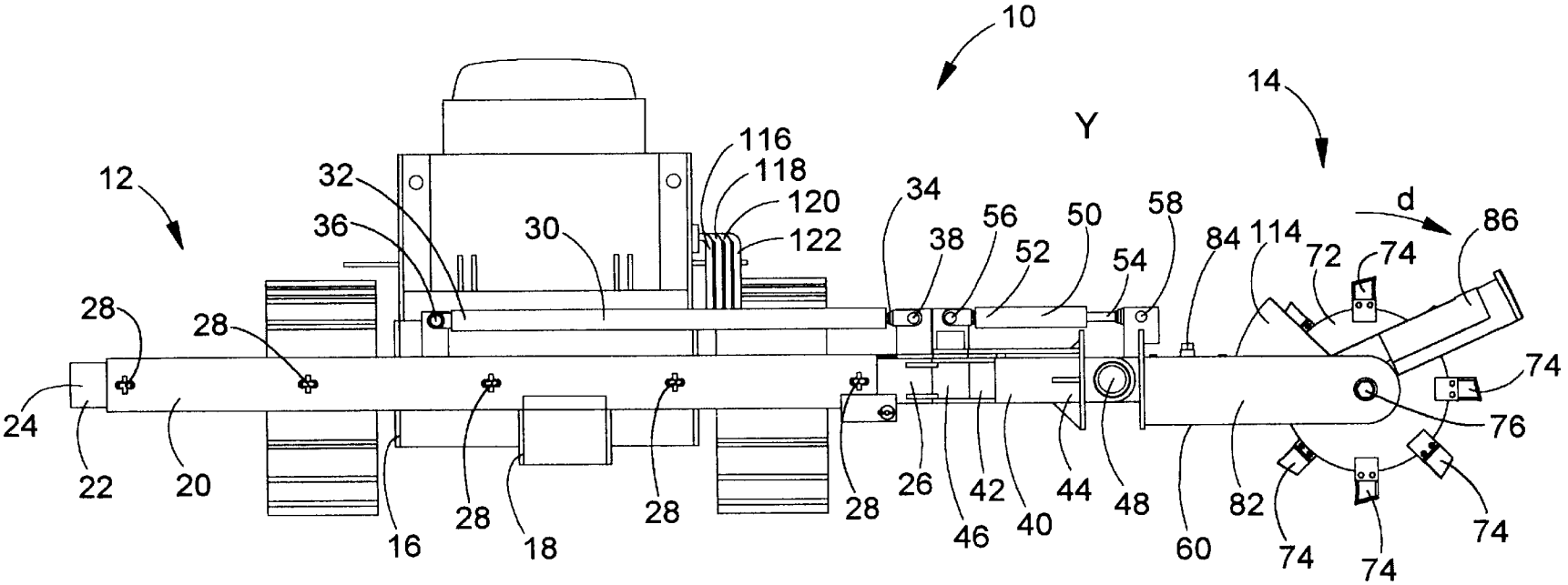
FIG. 4 is a rear elevation view of a trencher of the present invention, showing the trencher in a parallel, retracted position.
Figure 5:
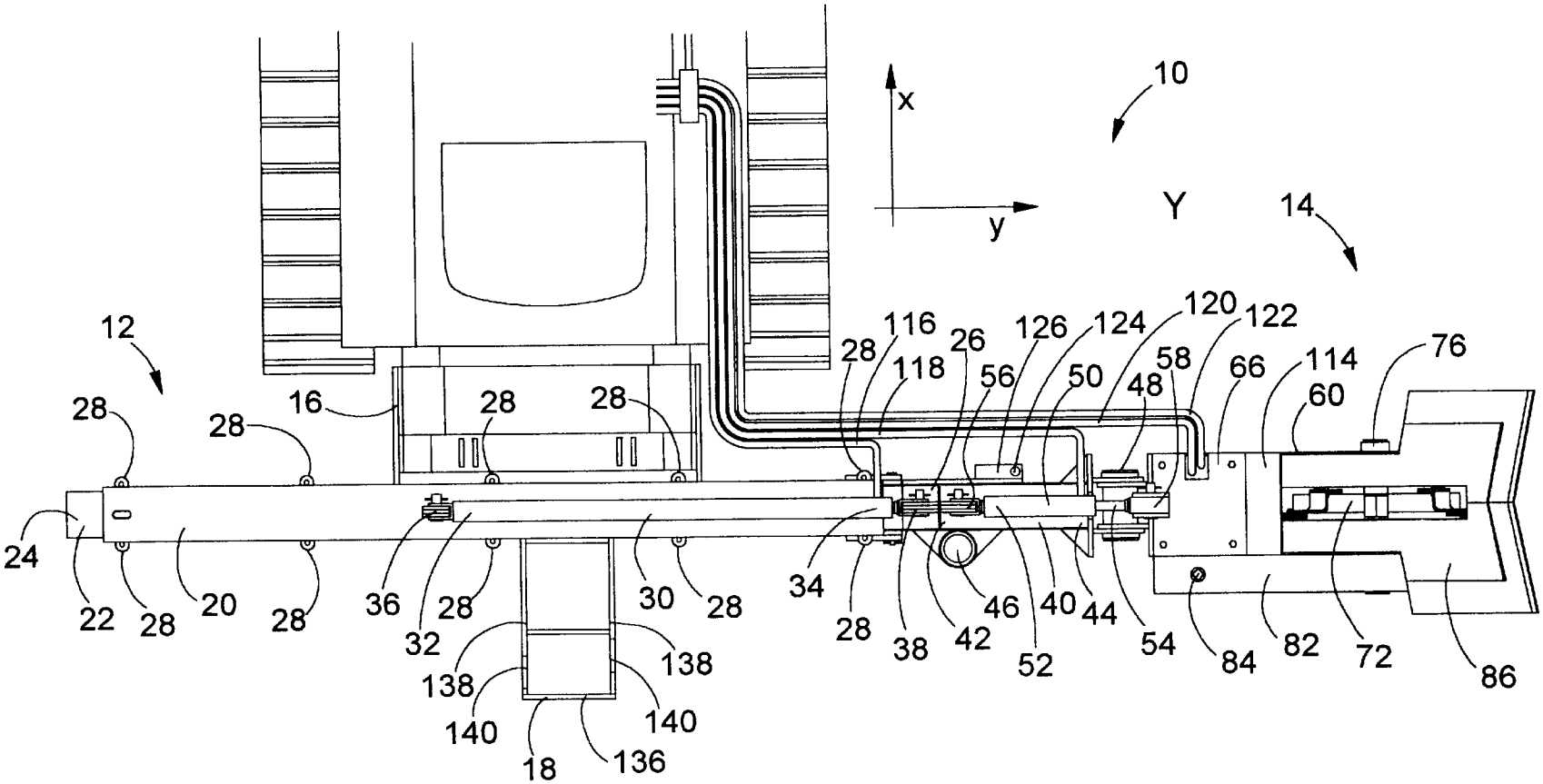
FIG. 5 is a top plan view of a trencher of the present invention, showing the trencher in a parallel, retracted position.
Figure 6:
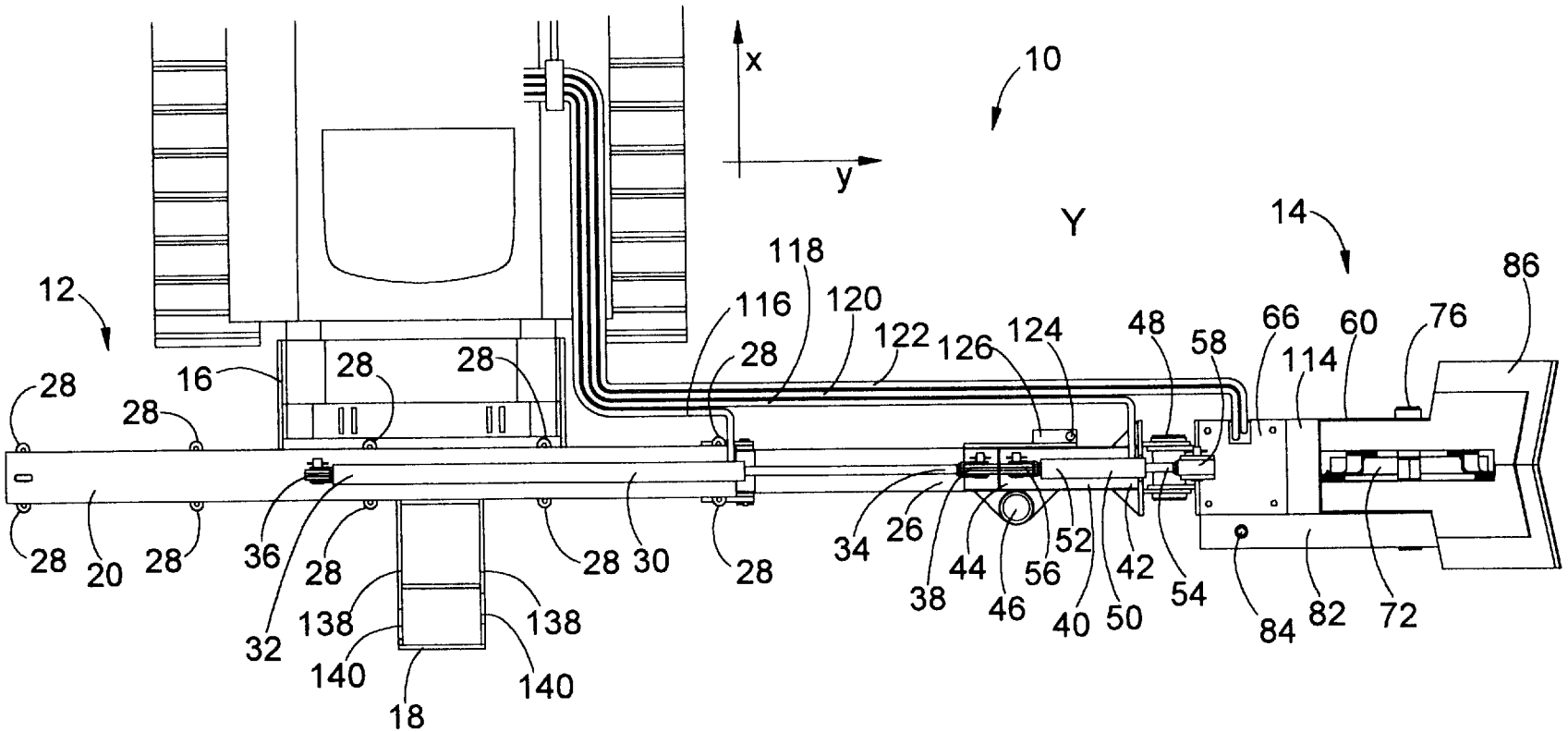
FIG. 6 is a top plan view of a trencher of the present invention, showing the trencher in a parallel, extended position.
Figure 7:
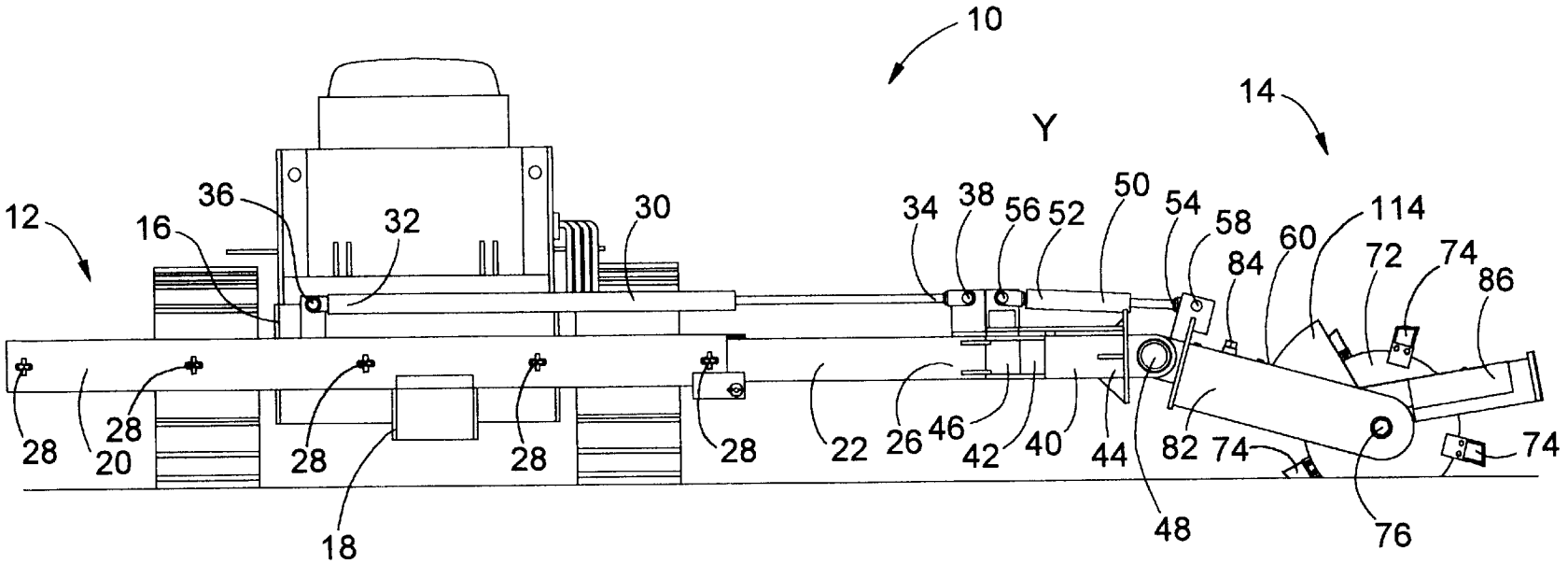
FIG. 7 is a rear elevation view of a trencher of the present invention, showing the trencher in an extended, operating position.

In configuration Y, the trencher 10 is operated by activating the hydraulic power supply to extend the first hydraulic actuator 30 from the retracted position shown in FIGS. 2, 4 and 5, and thus extend extension member 22 from its position inside stationary member 20. The length of the arm 12 is thereby increased to reach a beginning digging point, as shown in FIGS. 1 and 6. When the arm is extended to the desired length, the trenching head 14 is lowered to the soil by activating the hydraulic power supply to extend the second hydraulic actuator 50, causing the trenching head to pivot in a downward direction on the second hinge 48. In order to begin the trenching operation, the hydraulic power supply is activated to provide power to the motor 64, which turns motor shaft 68. As the motor shaft turns, first sprocket 70 also turns, engaging drive chain 80. The drive chain turns the second sprocket 78, which in turn rotates the trenching wheel 72 in a forward direction d. As the trenching wheel rotates, the teeth 74 cut a trench in the soil. The trenching head 14 can be lowered to the desired depth once the trenching wheel begins to turn. As the trenching wheel and teeth cut a trench in the soil, dirt and debris are tossed upward into the trenching head, where they are deflected by the second deflector 114 to land on the first deflector 86. The first deflector directs the dirt and debris away from the trenching wheel, and causes it to fall away, outside the newly cut trench.

With the trenching wheel 72 still turning, the first hydraulic actuator 30 is slowly retracted, thus sliding the extension member 22 into the stationary member 20. In this way, the arm 12 is shortened, and the trencher 10 is returned to the retracted position, as shown in FIGS. 2, 4 and 5. The motor 64 is then stopped, and the second hydraulic actuator 50 is retracted, thus raising the trenching head 14 above the ground. With the trencher in this position, the vehicle can be advanced to the next position where a trench in direction y is required.

The trencher 10 of the present invention can be secured in a stored position on the vehicle to which it is mounted, as shown in FIGS. 9–12. In the stored position, the swiveling member 40 is folded on the first hinge 46 so that it is adjacent to and nearly parallel with the stationary member 20. The body 60 of the trenching head 14 is received in the cradle 18. The cradle comprises one or more horizontal cradle arms 136, each having a top edge 138. In a preferred embodiment, the cradle arm includes at least two horizontal arms. A notch 140 cut in the top edge of the cradle arm receives the body 60 of the trenching head. The stored position is useful while the vehicle is being moved and the trencher is not in use. The stored position is also useful when the vehicle is parked.

In a preferred embodiment of the invention, the trenching head 14 may be optionally fitted with a dolly wheel 142 attached to the body 60 on the side opposite the protective case 82, as shown in FIG. 9. The dolly wheel is suspended from a dolly wheel bracket 144, which bolts to the body of the trenching head. When the trencher is used in configuration X, it may be desirable to allow the trenching head 14 to "float," to accommodate the contours of the ground. This is easily accomplished using hydraulic controls commonly available. The dolly wheel allows the trenching head to "float" while preventing it from sinking too deep in the soil. The dolly wheel swivels slightly to follow the path of the vehicle.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A trencher mountable to a vehicle, the trencher comprising:

a substantially horizontal hollow stationary member, the stationary member positioned substantially perpendicular to the direction of travel of the vehicle;

an extension member sized to be slidably received within the stationary member, the extension member having a first end and a second end, the first end being received within the stationary member;

a means for extending and retracting the extension member with respect to the stationary member;

a swiveling member having a first end and a second end, the first end of the swiveling member pivotably attached to the second end of the extension member, the swiveling member horizontally pivotable with respect to the extension member, and the swiveling member being securable in a position parallel to the extension member;

a trenching head pivotably attached to the second end of the swiveling member, the trenching head including a trenching wheel and a means for turning the trenching wheel;

a means for pivotably raising and lowering the trenching head with respect to the swiveling member; and a mounting frame for mounting the trencher to the vehicle.

2. The trencher of claim 1, wherein the means for lowering and raising the trenching head is a hydraulic actuator.

3. The trencher of claim 1, wherein the means for extending and retracting the extension member is a hydraulic actuator.

4. The trencher of claim 1, wherein the swiveling member is securable in a perpendicular position relative to the extension member.

5. The trencher of claim 1, wherein the swiveling member is securable in a stored position.

6. The trencher of claim 1, further comprising a cradle for receiving the trenching head in a stored position.

7. The trencher of claim 1, wherein the trenching head further comprises:

a body;

a motor, said motor having a motor shaft;

a motor compartment within the body for receiving the motor;

a first sprocket affixed to the motor shaft, said sprocket positioned outside the motor compartment;

a wheel shaft for being received within the trenching wheel;

a second sprocket affixed to the wheel shaft; and a drive chain operatively engaged between said first sprocket and said second sprocket.

8. The trencher of claim 7, wherein the trenching head further includes a protective case affixed to the body for enclosing the motor shaft, drive chain, and sprockets.

9. The trencher of claim 7, further comprising:

a first deflector for directing dirt and debris away from a newly cut trench, the first deflector positioned over the trenching head, and the first deflector comprising a first plate and a second plate, each plate having an upper edge, the upper edges of the plates meeting to form an apex over the trenching wheel; and a second deflector positioned over the trenching head opposite the first deflector, the second deflector for directing dirt and debris tossed up by the trenching wheel onto the first deflector.

10. The trencher of claim 9, wherein the first plate and the second plate are made of sheet steel and heavy rubberized fabric, the rubberized fabric being positioned adjacent to the trenching wheel.

11. The trencher of claim 7, wherein the motor is a hydraulic motor.

12. The trencher of claim 7, further comprising a dolly wheel attached to the body of the trenching head.

13. A trencher mountable to a vehicle, the trencher comprising:

a hollow stationary member;

an extension member sized to be slidably received within the stationary member, the extension member having a first end and a second end, the first end being received within the stationary member;

a means for extending and retracting the extension member with respect to the stationary member;

a swiveling member having a first end and a second end, the first end of the swiveling member pivotably attached to the second end of the extension member, the swiveling member being securable in a position parallel to the extension member;

a trenching head pivotably attached to the second end of the swiveling member, the trenching head including a trenching wheel and a means for turning the trenching wheel, and the trenching head further comprising: a body; a motor, said motor having a motor shaft; a motor compartment within the body for receiving the motor; a first sprocket affixed to the motor shaft, said sprocket positioned outside the motor compartment; a wheel shaft for being received within the trenching wheel; a second sprocket affixed to the wheel shaft; and a drive chain operatively engaged between said first sprocket and said second sprocket;

a means for raising and lowering the trenching head; and a mounting frame for mounting the trencher to the vehicle.

14. The trencher of claim 13, wherein the trenching head further includes a protective case affixed to the body for enclosing the motor shaft, drive chain, and sprockets.

15. The trencher of claim 13, further comprising:

a first deflector for directing dirt and debris away from a newly cut trench, the first deflector positioned over the trenching head, and the first deflector comprising a first plate and a second plate, each plate having an upper edge, the upper edges of the plates meeting to form an apex over the trenching wheel; and a second deflector positioned over the trenching head opposite the first deflector, the second deflector for directing dirt and debris tossed up by the trenching wheel onto the first deflector.

16. The trencher of claim 15, wherein the first plate and the second plate are made of sheet steel and heavy rubberized fabric, the rubberized fabric being positioned adjacent to the trenching wheel.

17. The trencher of claim 13, wherein the motor is a hydraulic motor.

18. The trencher of claim 13, further comprising a dolly wheel attached to the body of the trenching head.

* * * * *